US008120256B2

(12) United States Patent
Baacke et al.

(10) Patent No.: US 8,120,256 B2
(45) Date of Patent: Feb. 21, 2012

(54) DIRECT-CURRENT DISCHARGE LAMP

(75) Inventors: Swen-Uwe Baacke, Neuburg/Donau (DE); Stephan Berndanner, Petershausen (DE); Gerhard Löffler, Eichstätt (DE); Dirk Rosenthal, Gaimersheim (DE)

(73) Assignee: Osram AG, München (DE)

( * ) Notice: Subject to any disclaimer, the term of this patent is extended or adjusted under 35 U.S.C. 154(b) by 0 days.

(21) Appl. No.: 12/679,475

(22) PCT Filed: Sep. 21, 2007

(86) PCT No.: PCT/EP2007/060042

§ 371 (c)(1),
(2), (4) Date: Mar. 22, 2010

(87) PCT Pub. No.: WO2009/039880

PCT Pub. Date: Apr. 2, 2009

(65) Prior Publication Data

US 2010/0219751 A1 Sep. 2, 2010

(51) Int. Cl.
*H01J 17/04* (2006.01)

(52) U.S. Cl. ..... 313/620; 313/631; 313/570

(58) Field of Classification Search ..... 313/631, 313/632, 311, 326, 357, 570, 571, 335
See application file for complete search history.

(56) References Cited

U.S. PATENT DOCUMENTS 5,422,539 A * 6/1995 Chodora ..... 313/631

FOREIGN PATENT DOCUMENTS

| | | |
|---|---|---|
| DE | 42 29 317 | 3/1994 |
| EP | 1 801 247 | 6/2007 |

OTHER PUBLICATIONS

S. L. Slomski et al., "A new high-brightness projection arc lighting system", Illuminating Engineering USA, vol. 62, No. 4, pp. 229-235, Apr. 1967.

* cited by examiner

*Primary Examiner* — Joseph L Williams
*Assistant Examiner* — Brenitra Lee
(74) *Attorney, Agent, or Firm* — Cozen O'Connor

(57) ABSTRACT

A direct current discharge lamp with an anode (10) and a cathode (12) that are arranged opposite one another at a predetermined distance (r) inside a discharge vessel (14) filled with a filling gas, it being possible to apply electric power (P) to the anode (10) and the cathode (12) in order to produce a gas discharge. At least the predetermined distance (r) between the anode (10) and the cathode (12), the electric power (P) and a geometry of the anode (10) are adapted to one another in such a way that a region (22) of a surface (24) of the anode (10) facing the cathode (12) is free flowing in the heated state of the direct current discharge lamp.

6 Claims, 2 Drawing Sheets

DIRECT-CURRENT DISCHARGE LAMP

RELATED APPLICATIONS

This is a U.S. national stage of application No. PCT/EP2007/060042, filed on Sep. 21, 2007.

FIELD OF THE INVENTION

The invention relates to a direct current discharge lamp with an anode and a cathode that are arranged opposite one another at a predetermined distance inside a discharge vessel filled with a filling gas, it being possible to apply electric power to the anode and the cathode in order to produce a gas discharge.

BACKGROUND OF THE INVENTION

Such a direct current discharge lamp may already be taken as known from the prior art and comprises an anode and a cathode that are arranged opposite one another at a predetermined distance inside a discharge vessel (14) filled with a filling gas. In order to produce light, an electric power can be applied to the anode and the cathode, the result being the formation of a gas discharge in the region of an arc.

A disadvantageous circumstance with the known direct current discharge lamps may be seen in the substantial limitation of their useful life by a blackening of the discharge vessel. This blackening results from geometric variations in the surface of the anode facing the cathode in the heated state during operation of the direct current discharge lamp. In this case, local growths occur that lead to a concentration of the attachment of the arc. Very high temperatures that lead to an increased evaporation of the material of the anode can occur at these attachment points. The evaporated anode material is then deposited on the inside of the discharge vessel and leads to said blackening.

SUMMARY OF THE INVENTION

It is therefore one object of the present invention to provide a direct current discharge lamp of the type mentioned at the beginning that has a reduced blackening of the discharge vessel and thus a lengthened service life.

According to one embodiment of the invention, a direct current discharge lamp that has a reduced blackening of the discharge vessel and therefore a lengthened service life is characterized in that at least the distance between the anode and the cathode, the electric power and a geometry of the anode are adapted to one another in such a way that a region of a surface of the anode facing the cathode is free flowing in the heated state of the direct current discharge lamp. In other words, by adapting at least said parameters a free flowing state of the material of the anode is specifically produced during operation of the direct current discharge lamp in the region of its surface facing the cathode such that deformations of the surface occurring during operation are automatically compensated by subsequent flowing of the material, and a uniform anode plateau is ensured. This reliably prevents the occurrence of local growths with the associated high temperatures, and so there is a substantial reduction in the evaporation of the anode material. Owing to the self-healing ability of the anode, the direct current discharge lamp there fore exhibits a substantially weaker blackening of the discharge vessel and has a correspondingly lengthened service life.

In an advantageous refinement of the invention, it is provided that at least the distance between the anode and the cathode, the electric power and the geometry of the anode are adapted to one another in such a way that the region of the surface of the anode facing the cathode has a fluidity of at most $10^{-6}$ mPas, and preferably of at most $10^{-8}$ mPas in the heated state of the direct current discharge lamp. Such a limitation of the fluidity ensures that during operation of the direct current discharge lamp the material of the anode has a sufficiently high viscosity, and also that there is no macroscopic deformation owing to increased or frequent effects of force. The direct current discharge lamp can therefore, for example, also be used for illumination devices of motor vehicles or the like.

In a further advantageous refinement of the invention, it is provided that the anode consists of doped and/or undoped tungsten at least in the region of the surface facing the cathode. Owing to the high evaporation temperature and the chemical resistance of tungsten, the service life of the direct current discharge lamp can be additionally lengthened. Here, doped and/or undoped tungsten can be provided as a function of the desired illumination characteristic of the direct current discharge lamp. It is possible furthermore, in this case to provide that in addition to the parameters of electrode spacing, electric power and geometry of the anode, account is also taken of the characteristic properties of the respective material of the anode.

It has further proved to be advantageous in this case that the anode is of rotationally symmetrical design at least along a longitudinal region facing the cathode. During the heated state of the direct current discharge lamp, this permits on the surface of the anode the formation of a "melt pool" of large area and permanent stability. Because of the fact that the arc is attached over a large area and uniformly, the occurrence of operating temperatures above the respective evaporation temperature of the anode material is reliably avoided.

In a further advantageous refinement of the invention, it is provided that starting from the surface facing the cathode, the anode has a length of at least 5 mm. In this way, the anode acts in the heated state as a thermal heat store, thus ensuring that the temperature of the surface facing the cathode is as uniform as possible.

It has furthermore proved advantageous, that a quotient Q of the electric power in W and the distance between the anode and the cathode in mm is given in the heated state of the direct current discharge lamp by the relationship $$b_1*A^2+b_2*A+b_3<Q<a_1*A^2+a_2*A+a_3,$$

where:

$a_1=-0.0001\ W*mm^{-7}$;
$a_2=0.42\ W*mm^{-4}$;
$a_3=687\ W*mm^{-1}$;
$b_1=-0.0003\ W*mm^{-7}$;
$b_2=0.8967\ W*mm^{-4}$; and
$b_3=88\ W*mm^{-1}$, A denoting the volume of the anode in $mm^3$ on the first 5 mm length starting from the surface facing the cathode. This ensures an operation of the direct current discharge lamp in a region in which, given gas discharge lamps with anodes of sufficient length, on the one hand the required ability to free flow, and on the other hand a reliable reduction in the evaporation of the material of the anode in the region of the surface are attained.

EXEMPLARY EMBODIMENT OF THE INVENTION

Figure 1:
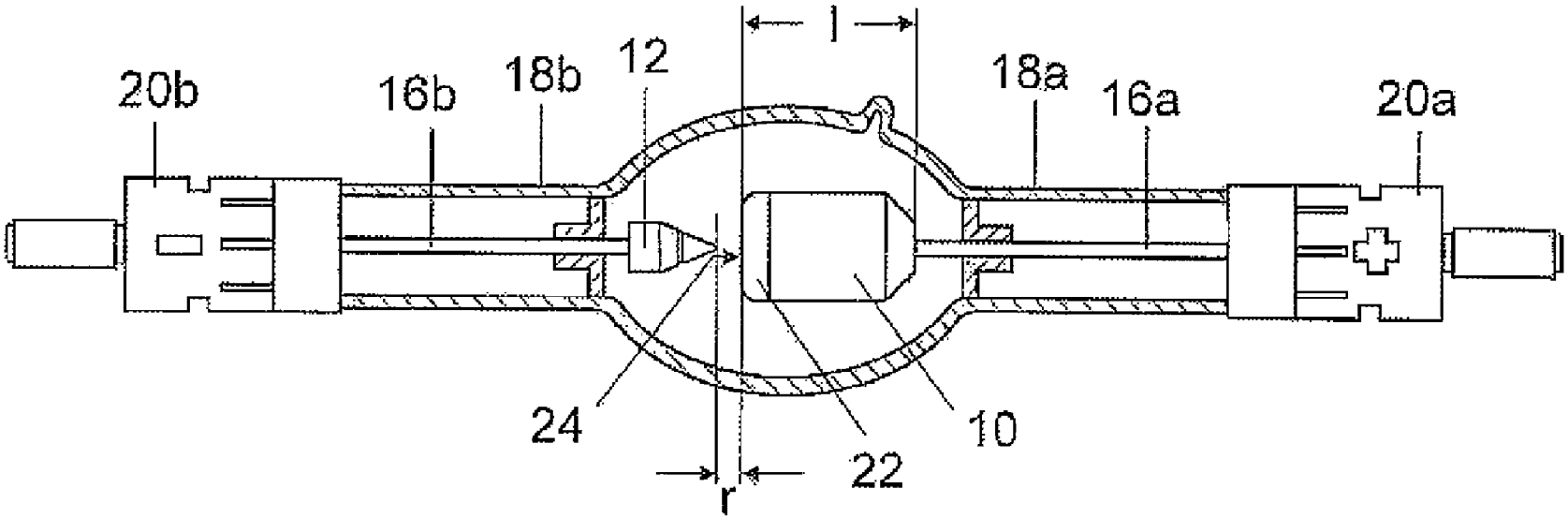
FIG. 1 shows a schematic and partially sectioned side view of a direct current discharge lamp in accordance with an exemplary embodiment.

FIG. 1 shows a schematic and partially sectioned side view of a direct current discharge lamp in accordance with an exemplary embodiment, in this case designed as a xenon short arc lamp. The direct current discharge lamp in this case comprises an anode 10 and a cathode 12 that are arranged opposite one another at a predetermined distance r inside a discharge vessel 14 filled with xenon. The anode 10 in this case has a length 1 that can, for example, be selected between 15 mm and 50 mm as a function of the watt number of the direct current discharge lamp. The anode 10 and the cathode 12 are, furthermore, coupled to corresponding base elements 20*a*, 20*b* via assigned connecting elements 16*a*, 16*b* that are guided through shaft tubes 18*a*, 18*b* of the direct current discharge lamp which are sealed in a gastight fashion. An electric power P can be applied via the base elements 20*a*, 20*b* to the anode 10 and the cathode 12 in order to produce a gas discharge or to form an arc. Both the anode 10 and the cathode 12 are of rotationally symmetrical design and both consist of tungsten in the present exemplary embodiment. In order to ensure reduced blackening of the discharge vessel 14 and, at the same time, a lengthened service life during operation of the direct current discharge lamp, the distance r between the anode 10 and the cathode 12, the electric power P and the geometry of the anode 10 are adapted to one another in such a way that a region 22 of a surface 24 of the anode 10 facing the cathode 12 is free flowing in the heated state of the direct current discharge lamp. Consequently, irregularities in the surface 24 that form during operation owing to the subsequent flowing of the material of the anode 10 are automatically compensated again, the result being significant reduction in the occurrence of temperature peaks and the associated evaporation of the material of the anode 10. It can optionally be provided in this case that in the given geometric configuration of the direct current discharge lamp, in particular the distance r and the geometry of the anode 10, electric power P is adapted and regulated as appropriate in order specifically to ensure the desired ability of the region 22 to free flow. Conversely, for a given electric power P it is possible to design the geometric configuration of the direct current discharge lamp appropriately in order to attain the desired ability to free flow. An optimum distance r can respectively be ensured thereby, as can an optimum geometric configuration of the anode 10 and, if appropriate, of the cathode 12, taking account of the desired illumination characteristic of the direct current discharge lamp. By contrast with the prior art, there is thus no need for an additional coating of the anode 10 or for a forced reduction of the electric power P. However, it is also possible to provide alternative variant refinements of the direct current discharge lamp familiar to the person skilled in the art instead of the xenon short arc lamp shown as a refinement.

Figure 2:
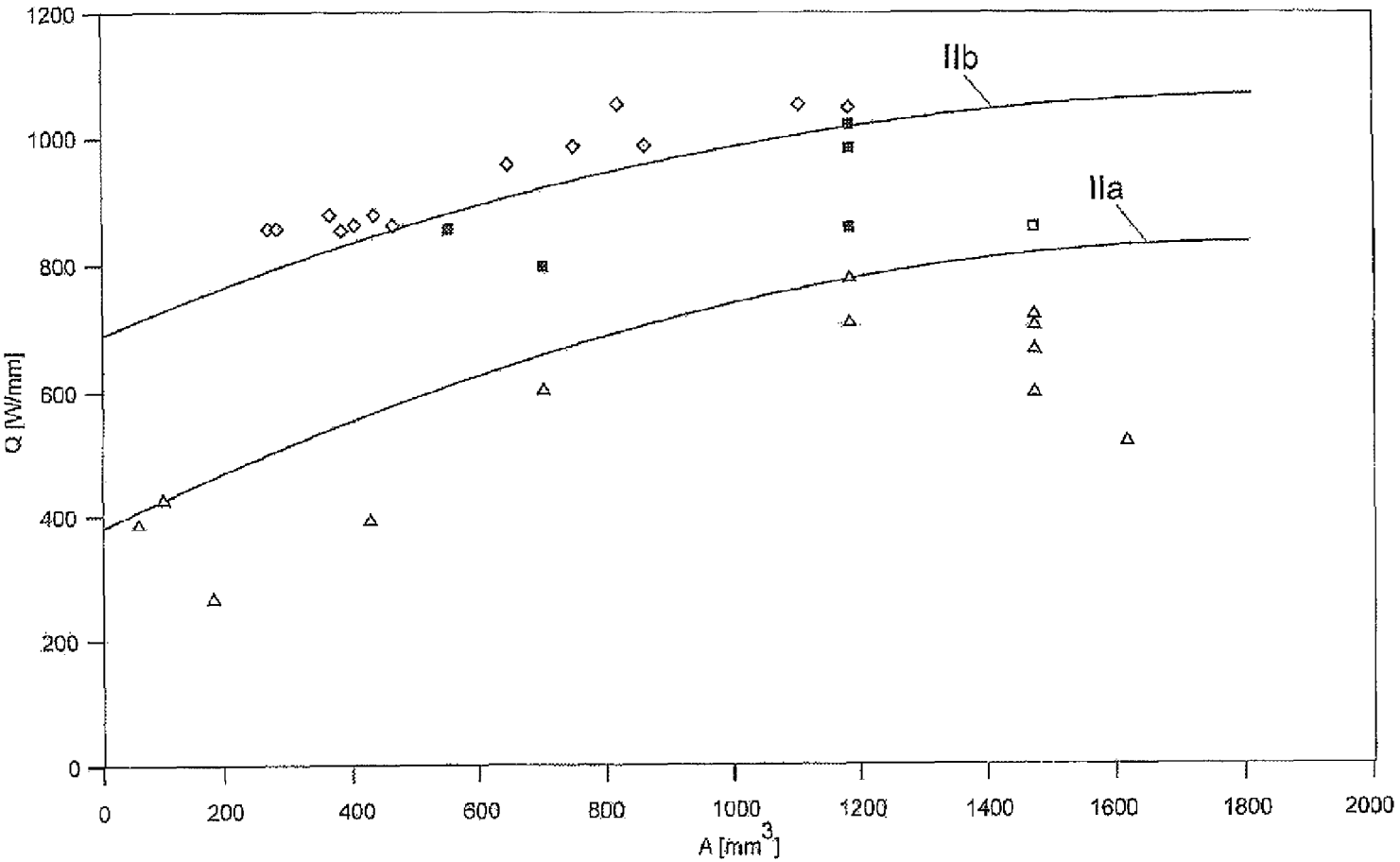
FIG. 2 shows a schematic diagram of a relationship between an arc temperature and a temperature response of an anode of the direct current discharge lamp shown in FIG. 1.

FIG. 2 shows a schematic diagram of a relationship between an arc temperature and a temperature response of the anode 10 of the direct current discharge lamp shown in FIG. 1. The arc temperature corresponding to the supply of energy to the direct current discharge lamp is characterized here by a quotient Q [W/mm] of the electric power P in W, and the distance r in mm between the anode 10 and the cathode 12 in the heated state of the direct current discharge lamp. The temperature response in the anode corresponding to the energy losses of the direct current discharge lamp is characterized by the amount of material in the region 22 of the surface 24, and thus by the volume A [$mm^3$] of the anode 10 of the first 5 mm length (½), starting from the surface 24 facing the cathode 12. The depicted symbols, diamonds, squares and triangles, correspond to the parameters Q, A of various real lamps. Here, the two polynomial compensation curves IIa and IIb delimit a suitable parameter range within which an optimum temperature of the surface 24 with the desired ability to free flow of the region 22, and the low blackening of the discharge vessel 14 associated therewith are ensured. The upper compensation curve IIb is described in this case by the formula:

$$Q=a_1*A^2+a_2*A+a_3$$

where:

$a_1=-0.0001$ W*$mm^{-7}$;
$a_2=0.42$ W*$mm^{-4}$; and
$a_3=687$ W*$mm^{-1}$, and the lower compensation curve IIa by a formula $$Q=b_1*A^2+b_2*A+b_3$$

where:

$b_1=-0.0003$ W*$mm^{-7}$;
$b_2=0.8967$ W*$mm^{-4}$; and
$b_3=88$ W*$mm^{-1}$.

Owing to the high energy input, undesired fusings of the anode 10, instabilities of the arc and increased evaporation of the material of the anode 10 occur in the region above the compensation curve IIb. Conversely, in the region below the compensation curve IIa no sufficient ability to free flow, and therefore also no permanently stable "melt pool" are achieved on the surface 24 of the anode 10, which means that it is impossible to remedy irregularities in the surface 24 occurring during operation. Only lamps whose parameters Q and A fall into the middle range, which is essentially delimited by the two compensation curves IIa and IIb, exhibit a good operational performance.

The scope of protection of the invention is not limited to the examples given hereinabove. The invention is embodied in each novel characteristic and each combination of characteristics, which includes every combination of any features which are stated in the claims, even if this feature or combination of features is not explicitly stated in the examples.

The invention claimed is:

1. A direct current discharge lamp with an anode and a cathode that are arranged opposite one another at a predetermined distance inside a discharge vessel filled with a filling gas, wherein at least the predetermined distance between the anode and the cathode, electric power applied to the anode and the cathode to produce a gas discharge, and a geometry of the anode are selected such that a region of a surface of the anode facing the cathode is free flowing in the heated state of the direct current discharge lamp, wherein starting from the surface facing the cathode, the anode has a length of at least 5 mm, and wherein a quotient Q of the electric power in W and the distance between the anode and the cathode in mm is defined in at least the heated state of the direct current discharge lamp by the relationship $$b_1*A^2+b_2*A+b_3<Q<a_1*A^2+a_2*A+a_3,$$

where:

$a_1=-0.0001$ W*$mm^{-7}$;
$a_2=0.42$ W*$mm^{-4}$;
$a_3=687$ W*$mm^{-1}$;
$b_1=-0.0003$ W*$mm^{-7}$,
$b_2=0.8967$ W*$mm^{-4}$; and
$b_3=88$ W*$mm^{-1}$, A denoting the volume of the anode in $mm^3$ on the first 5 mm length starting from the surface facing the cathode.

2. The direct current discharge lamp as claimed in claim 1, wherein at least the predetermined distance between the anode and the cathode, the electric power and the geometry of the anode are selected so that the region of the surface of the anode facing the cathode has a fluidity of at most $10^{-6}$ mPas in the heated state of the direct current discharge lamp.

3. The direct current discharge lamp as claimed in claim 2, wherein the anode consists of at least one of doped and undoped tungsten at least in the region of the surface facing the cathode.

4. The direct current discharge lamp as claimed in claim 1, wherein the anode is of rotationally symmetrical design at least along a longitudinal region facing the cathode.

5. The direct current discharge lamp as claimed in claim 2, wherein at least the predetermined distance between the anode and the cathode, the electric power and the geometry of the anode are adapted to one another in such a way that the region of the surface of the anode facing the cathode has a fluidity of at most $10^{-8}$ mPas in the heated state of the direct current discharge lamp.

6. The direct current discharge lamp as claimed in claim 1, wherein the anode consists of at least one of doped and undoped tungsten at least in the region of the surface facing the cathode.

* * * * *